US012741223B2

(12) United States Patent
Rubins et al.

(10) Patent No.: US 12,741,223 B2
(45) Date of Patent: Sep. 22, 2026

(54) ZIPLINE SYSTEM AND A METHOD FOR CONTROL OF A ZIPLINE SYSTEM

(71) Applicant: LGK GRUPA, SIA, Siguidas (LT)

(72) Inventors: Arnis Rubins, Siguidas (LT); Arturs Rimsa, Siguidas (LT); Ivars Beitans, Siguidas (LT)

( * ) Notice: Subject to any disclaimer, the term of this patent is extended or adjusted under 35 U.S.C. 154(b) by 389 days.

(21) Appl. No.: 18/682,937

(22) PCT Filed: Aug. 10, 2022

(86) PCT No.: PCT/LV2022/050008

§ 371 (c)(1),
(2) Date: Feb. 12, 2024

(87) PCT Pub. No.: WO2023/018322

PCT Pub. Date: Feb. 16, 2023

(65) Prior Publication Data

US 2024/0367061 A1 Nov. 7, 2024

(30) Foreign Application Priority Data

Aug. 10, 2021 (LV) ..... P2021000046

(51) Int. Cl.
*A63G 21/22* (2006.01)

(52) U.S. Cl.
CPC ..... *A63G 21/22* (2013.01)

(58) Field of Classification Search
CPC ..... A63G 21/22; B61B 12/12
USPC ..... 104/112
See application file for complete search history.

(56) References Cited

U.S. PATENT DOCUMENTS 1,344,677 A * 6/1920 Coanda ..... B61B 7/00 104/117
1,422,032 A * 7/1922 Chapman ..... A63G 21/20 104/23.1
5,653,174 A * 8/1997 Halus ..... H02K 41/02 104/282
8,398,497 B2 * 3/2013 Crawford ..... A63G 27/02 472/43
10,005,477 B2 * 6/2018 Louwsma ..... A63G 21/20
(Continued)

FOREIGN PATENT DOCUMENTS

RU 2751126 C2 * 7/2021 ..... B64B 1/06
WO WO-03080206 A1 * 10/2003 ..... A63G 21/20
WO WO-2008087496 A2 * 7/2008 ..... B61B 7/06

*Primary Examiner* — Troy Chambers
(74) *Attorney, Agent, or Firm* — PatShegen IP; Moshe Pinchas

(57) ABSTRACT

The present invention relates to zipline systems and control thereof. A zipline system comprising a starting base (1), a finish base (14) and a zipline (2) extended therebetween. The system comprise a trolley (16) arranged on the zipline (2). The trolley (16) comprises two wings (18), harnesses (19) attached to each wing (18) and configured to secure riders (5) of the system. The trolley (16) comprises a thrust generating unit (4) to provide a forward thrust to the trolley (16), an energy storage unit to store energy for the thrust generating unit (4) and a power control unit to control the thrust generating unit (4). Each wing (18) comprises a weight distribution system (20) to balance a centre of gravity of the trolley (16) along its vertical axis (X). The system further comprises a retrieve track (6) to retrieve the trolley (16) back to the starting base (1).

11 Claims, 6 Drawing Sheets

(56) References Cited

U.S. PATENT DOCUMENTS

| | | | | |
|---|---|---|---|---|
| 10,322,729 | B2 * | 6/2019 | Suppes | B64C 39/022 |
| 2002/0185569 | A1 * | 12/2002 | Henne | A63G 7/00 472/130 |
| 2010/0326311 | A1 * | 12/2010 | Simon | E01B 25/00 104/23.1 |
| 2012/0066154 | A1 * | 3/2012 | Harrington | B61B 7/06 104/23.1 |
| 2017/0106878 | A1 * | 4/2017 | Louwsma | A63G 21/22 |

* cited by examiner

ZIPLINE SYSTEM AND A METHOD FOR CONTROL OF A ZIPLINE SYSTEM

The present invention relates to zipline systems and control thereof.

The prior art discloses various zipline systems which have one common general concept. This concept involves a zipline extended between two point or bases wherein the start point or base is above the finish point or finish base so that the rider of the zipline may travel along the zipline from the start base to the finish base solely under force of gravity. Such ziplines are disclosed in the international application publications Nos. WO2009/000059 and WO2016/133408. Such ziplines requires certain geographical features, for example, mountainous regions where it is possible to create necessary height difference between the start base and the finish base. Hence it is necessary to create a zipline system which may function as a normal zipline system or even better without requiring geographical prerequisites—the system may be used in flatlands.

There have been some attempts in creation or at least mentioning of self-propelled trolleys of the sip line. International application publication No. WO2021015630 discloses a transport system and method of transporting objects including people between locations. The description also relates to urban and public transport systems for moving large numbers of people and freight or objects between locations. The description also relates to transport systems based on cable and rail elements and moving therebetween. Also described are junction mechanisms, switching and control systems. The publication conceptually mentions a use of a flywheel as the rotation of the flywheel may then be connected to a drive wheel of a trolley such that the flywheel provides rotation and motive power to the trolley drive wheel. In the case of an internal combustion engine, connection could be made to the drive elements in a similar manner to that of an electric motor. In an alternative configuration a motor (electric or internal combustion for example) may drive a fan system, the fan system providing thrust that can be used to provide motive effort on the trolley. The publication does not provide further information on how to implement the drive in an effective and safe manner in the zipline or especially in the trolley of the zipline.

The aim is reached by design of a new zipline system and especially a new trolley of the zipline. The zipline system as any other zipline system comprises a starting base, a finish base and a zipline that extends between the starting base and the finish base. The zipline is attached with one of its ends to the starting base and with another end to the finish base. The zipline system comprises a trolley which moves along the zipline to transport the rider or user of the zipline system.

The trolley comprises a body and at least two wheels rotationally connected to the body. The wheels rest on the zipline so that the trolley can move along the zipline. The trolley is characterized in that it comprises two protrusions or wings horizontally extending sideways from the body of the trolley. The wings extend away from each other so that the trolley looks like an airplane. The trolley also comprises a harness or actually two harnesses. Each harness is attached under each wing. The harness is configured to secure a rider to the trolley of the zipline system. In a preferred embodiment of the invention, the harness is rigidly attached to the wing to avoid any unnecessary inertia during acceleration of the trolley.

Each wing is made of interconnected wing panels so that the wing is a box like structure forming a space enclosed by the wing panels.

The trolley is further characterized in that it comprises a thrust generating unit attached to the body of the trolley. The thrust generating unit is configured to provide a forward thrust to the trolley. In a preferred embodiment the thrust generating unit is an electric turbine, but it may be also a fan, a propeller or a jet turbine. The trolley comprises an energy storage unit associated with thrust generating unit and configured to store energy for the thrust generating unit. The energy storage unit in a case of the electric turbine is a battery which is electrically connected to the electric turbine. In a case of the jet turbine, the energy storage unit is a fuel tank. The trolley further comprises a power control unit associated with the thrust generating unit and the energy storage unit. The power control unit is configured to provide a power from the energy storage unit to the thrust generating unit in a pre-set manner. Pre-setting is performed by the operator of the system. The operator basically sets a time limit for how long the power should be provided to the thrust generating unit from the start of the ride.

The thrust generating unit may be arranged above the wings and positioned on the vertical axis of the trolley or may be arranged below the wings and positioned on the vertical axis of the trolley. In another embodiment or in the embodiment of two thrust generating units each thrust generating unit is arranged above the wings and positioned symmetrically relative to the vertical axis of the trolley and to each other. In another embodiment, the two thrust generating units may be arranged so that each thrust generating unit is arranged at the tip or at a free end of the wing of the trolley.

In one embodiment of the invention, the energy storage unit as a battery comprises just enough power to accelerate the trolley along the zipline and not more so that the trolley cannot be accelerated further that the length of the zipline. This is a safety feature so that in any case of emergency the battery will not be able to supply the turbine with the power till the end of the zipline. In the preferred embodiment the turbine is arranged above the wings and positioned on the vertical axis of the trolley so that the weight of the turbine is distributed symmetrically.

The zipline system further comprises a retrieve track configured to retrieve the trolley back to the starting base when the trolley has stopped along the zipline, for example, at the lowest point of the zipline, or when the trolley has reached the finish base and should be pulled back to the starting base. In one embodiment of the invention, the retrieve track is a rope attached to the trolley. After every run the rope allows to pull the trolley back to the starting base wherever the trolley stops. In another embodiment of the invention, the retrieve track can be a conveyer type retrieve system.

In addition each wing comprises a weight distribution system in order to balance a centre of gravity of the trolley along the vertical axis of the trolley depending on the uneven weight of the riders of the trolley. This system is necessary in order to achieve a perfect balance between the two wings or sides where the users or riders of the trolley are secured. Uneven weight of both users or riders shall be balanced. The weight distribution system is built in the space enclosed by the wing panels of the wing. The weight distribution system comprises at least one guide bar arranged within the wing, stoppers arranged on the guide bar at a predefined distance from each other, and weights arranged on the guide bar and between the stoppers. The weights can be changed and adjusted through an opening in the wings. The opening in the wing is closed by a lid so that the wing maintains its aerodynamical shape.

The zipline is attached to the starting base and to the finish base via attachment points. The present invention allows to design such a zipline where the attachment point of the zipline to the starting base and the attachment point of the zipline to the finish base are on the same level. Nevertheless, the zipline system may also be as traditional one, where the attachment point of the zipline to the starting base in higher than the attachment point of the zipline to the finish base.

The zipline may be stretched between the starting base and the finish base as a straight line. In another embodiment the zipline may be stretched so that the middle section of the zipline is lower than the sections of the zipline at the starting base and the finish base.

The harness where the rider or the user is secured may be rigidly attached to the wing so that all members of the trolley are moved as one integral object.

The present invention is also a method for control of a zipline system, especially a method to control a travel of the trolley in the zipline system. A travel includes acceleration of the trolley, braking of the trolley as well as its retrieve.

The riders are secured in the harnesses of the trolley at the starting base. The next step involves balancing of the trolley by the means of weight distribution system in order to bring the centre of gravity of the trolley on the vertical axis of the trolley. The operator knows a weight of each rider under each wing and the operator compensates the weight difference by adding additional weight to the wing under which the lightest rider is secured. The ride of the trolley starts, and the trolley accelerates along the zipline by means of the thrust generating unit for at least a part of the zipline length, which is followed by the switch off of the thrust generating unit. The trolley stops under its own inertia, drag and resistance. When the trolley has stopped, it is returned to the starting base by a means of the retrieve track. Subsequentially, at the starting base the riders are un-secured from the harnesses of the trolley.

The trolley may be accelerated at various points along the zipline depending of settings of the operator as well as depending on a configuration of the zipline.

In the embodiment where the zipline is stretched so that the middle section of the zipline is lower than the sections of the zipline at the starting base and the finish base, the trolley is accelerated by the means of the thrust generating unit until the lowest point of the zipline in relation to the attachment points of the zipline to the starting base and the finish base. Then the thrust generating unit is switched off and the trolley continues its movement under inertia for some distance. The trolley stops and under its own weight moves to the lowest point of the zipline. When the trolley reaches the lowest point of the zipline, it is retrieved by means of the retrieve track to the starting base.

The drawings illustrate generally, by way of example, but not by way of limitation, various embodiments of the invention.

FIG. 1 illustrates a zipline system comprising a starting base (1), a finish base (14) and a zipline (2). The zipline (2) is stretched between the starting base (1) and the finish base (14) and attached to the starting base (1) via attachment point (1A) and to the finish base (14) through another attachment point (14A).

Figure 1:
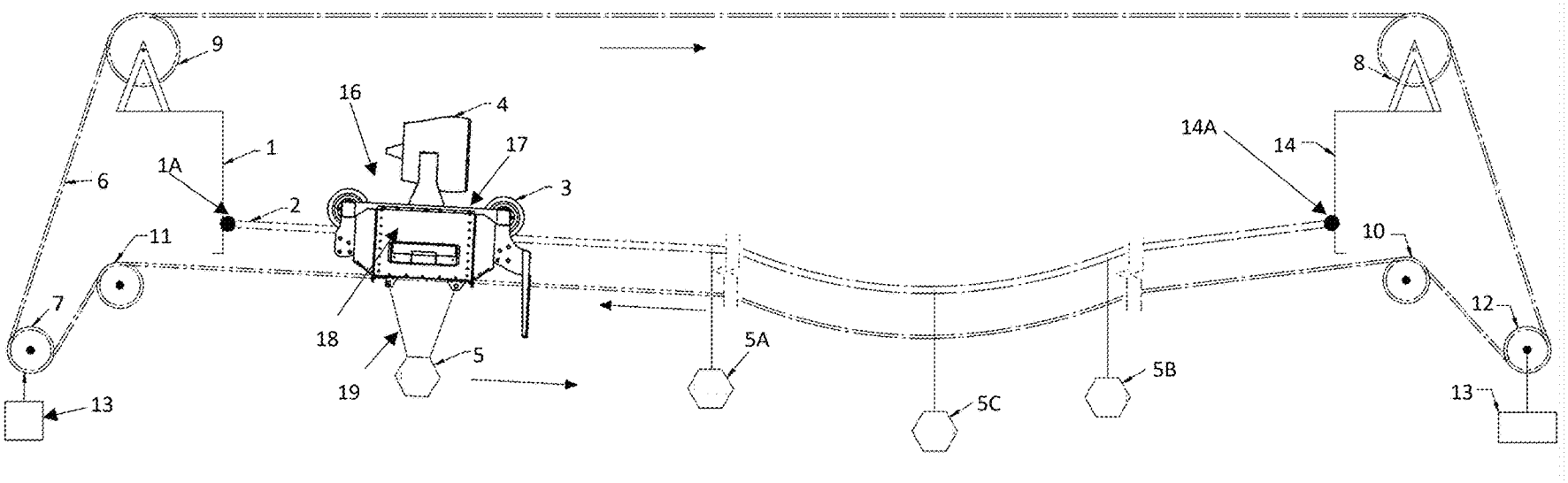
FIG. 1 is principal scheme of a zipline system.
Figure 2:
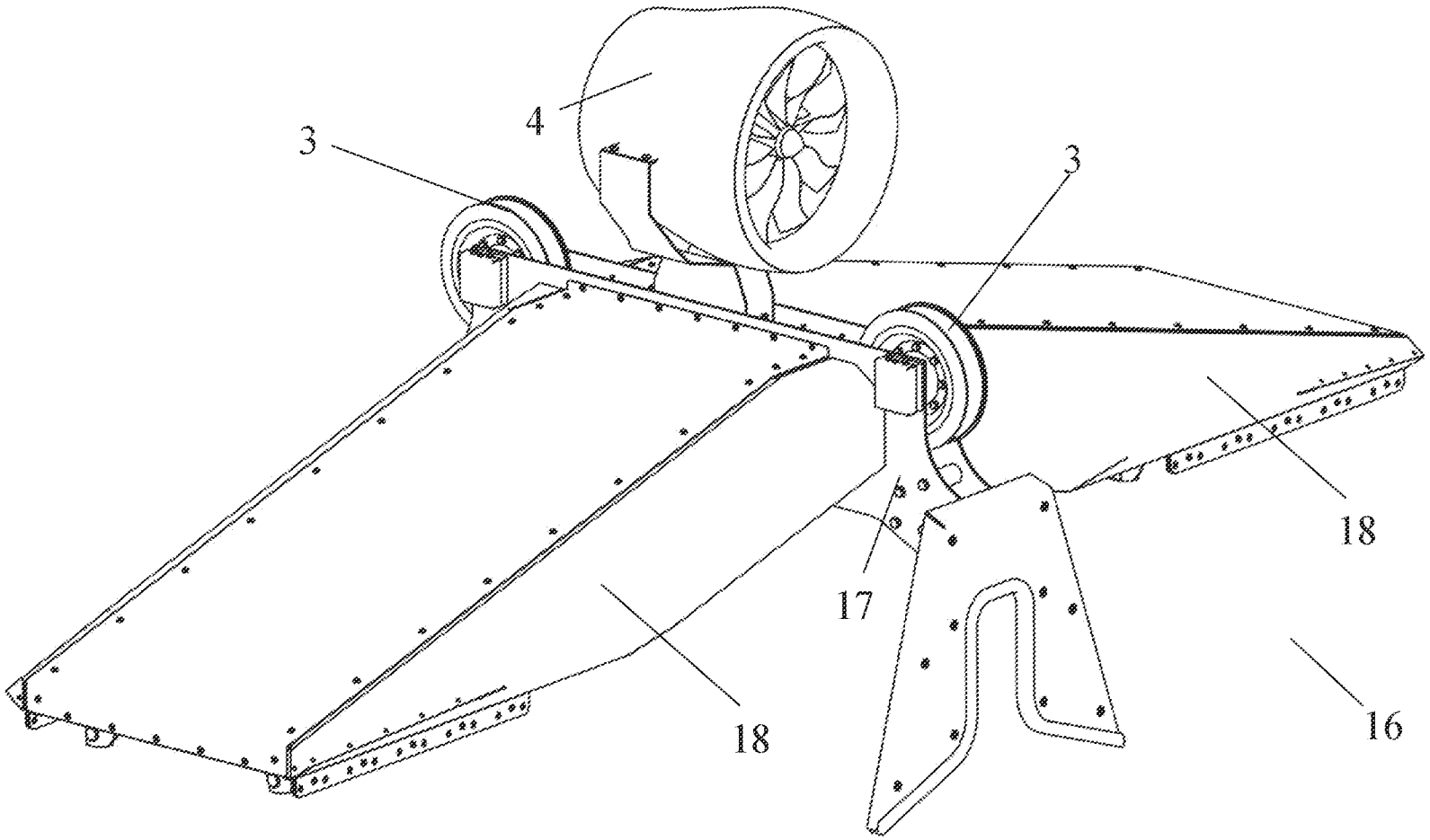
FIG. 2 is a front perspective view of a trolley (16).

The zipline system comprises a trolley (16) as seen in FIGS. 1 to 5. The trolley (16) comprises a body (17) and two wheels (3) rotationally connected to the body (17). Both wheels (3) rest on the zipline (2) so that the trolley (16) can move along the zipline (2). Two wings (18) are attached to the body (17) of the trolley (16). The trolley (16) further comprises two harnesses (19) for securing two riders (5) of the zipline system. Each harness (19) is attached to the respective wing (18).

Figure 3:
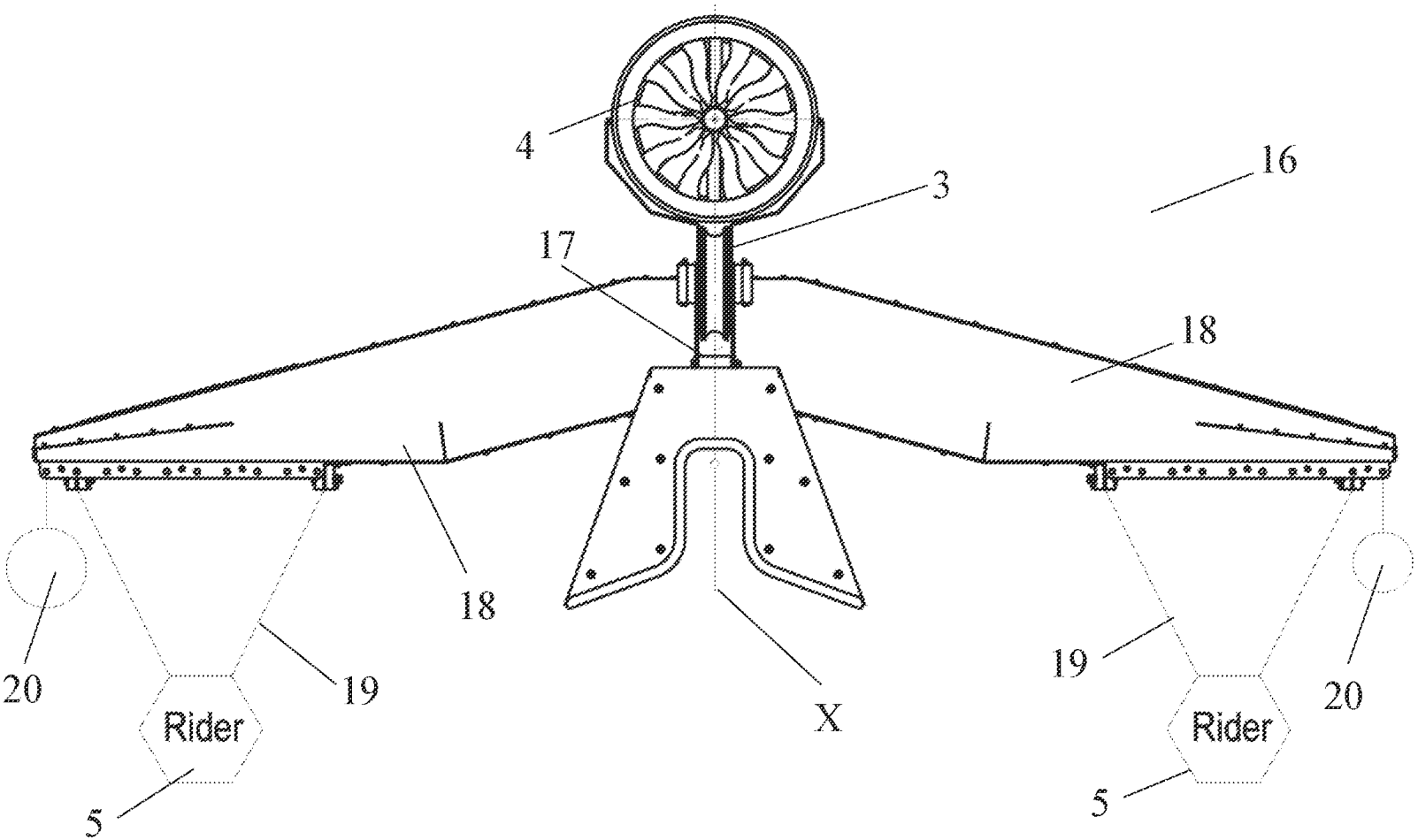
FIG. 3 is a front view of a trolley (16).
Figure 4:
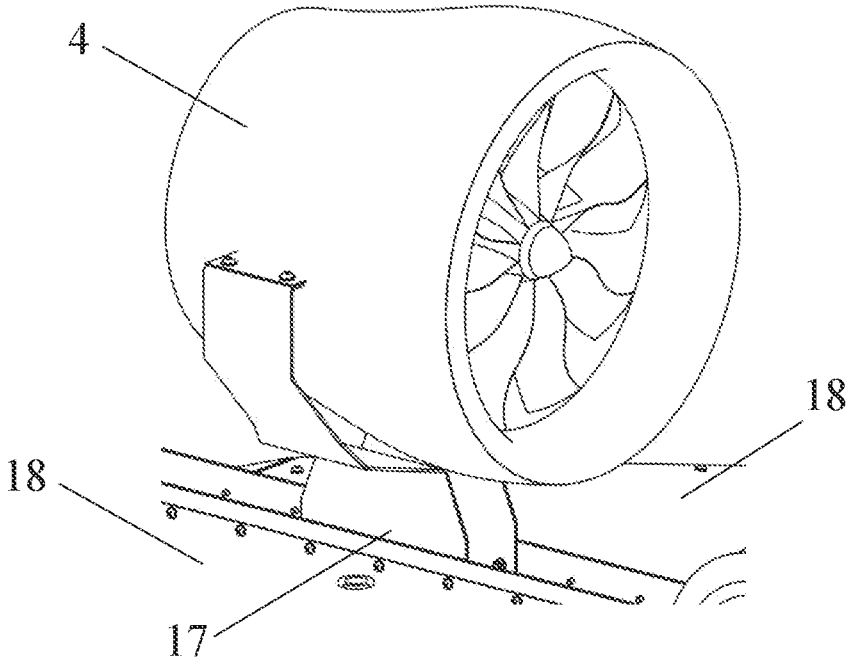
FIG. 4 is a close-up view of the turbine (4) as seen in FIGS. 2 and 3.
Figure 5:
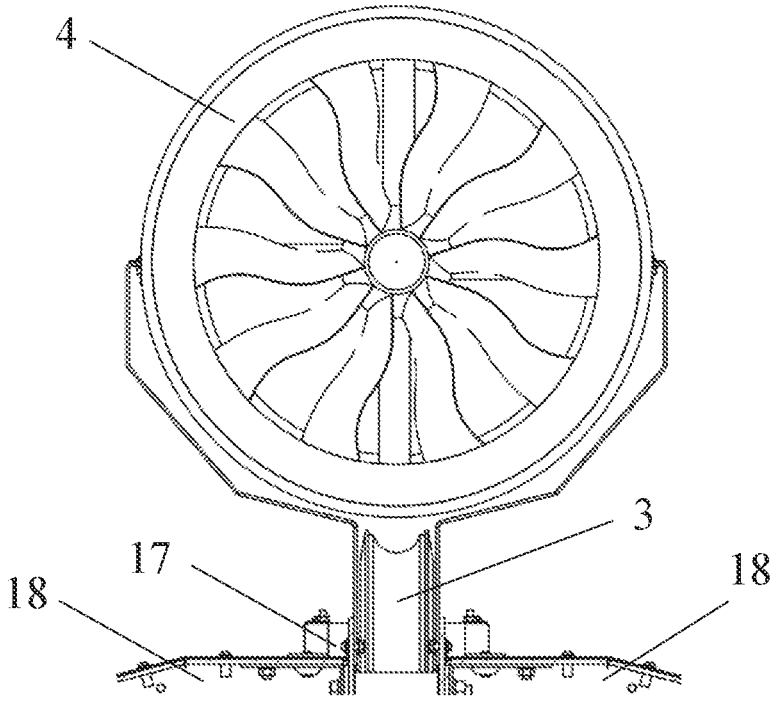
FIG. 5 is a front view of the turbine (4) as seen in FIGS. 2 to 4.
Figure 6:
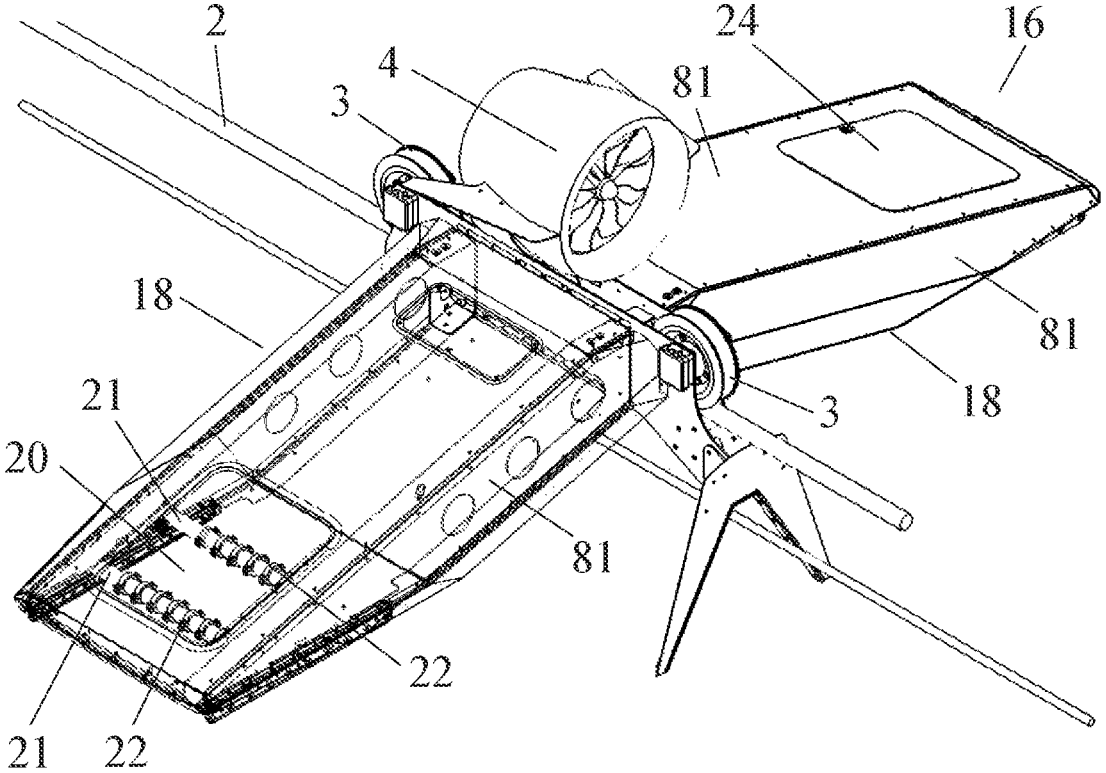
FIG. 6 is front perspective view of a trolley (16) on the zipline (2) illustrating a weight distribution system (20).
Figure 7:
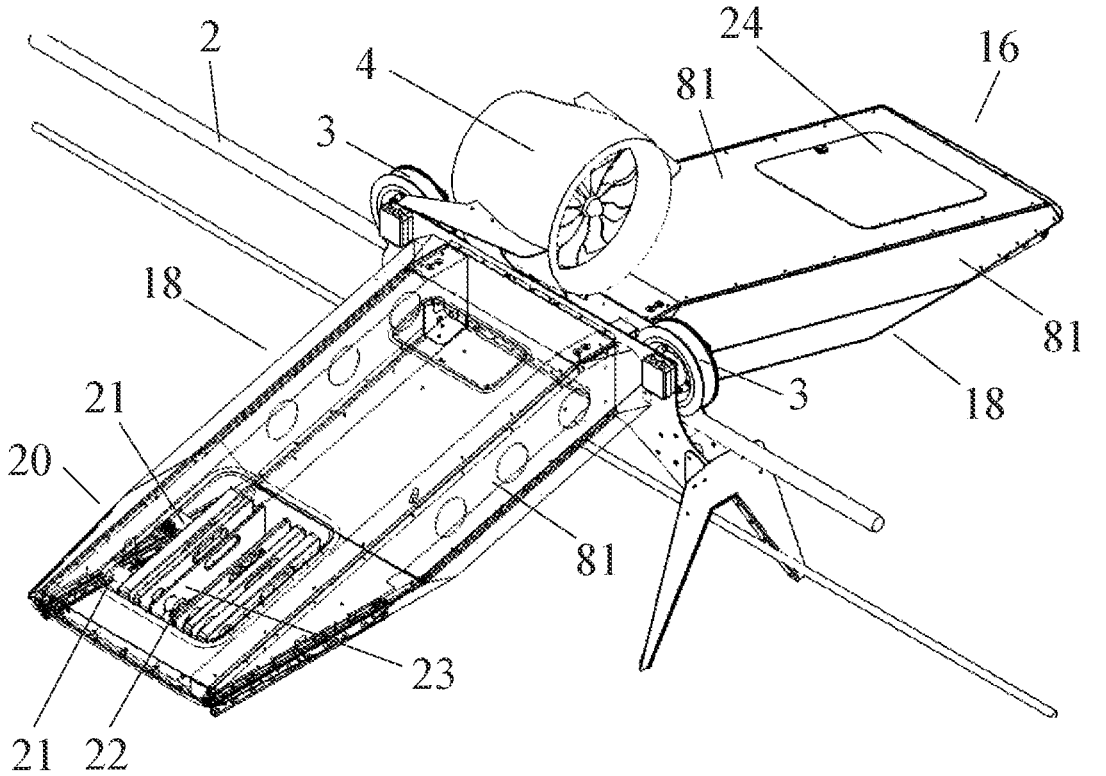
FIG. 7 is front perspective view of the trolley (16) as seen in FIG. 6, but with addition of weights (23) to the weight distribution system.
Figure 8:
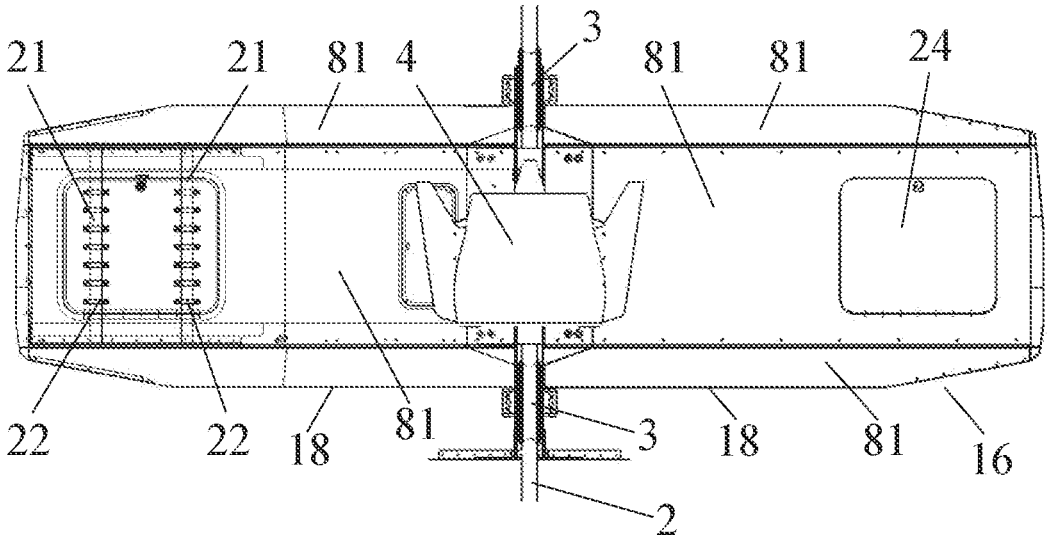
FIG. 8 is a top view of the trolley (16) as seen in FIG. 6.
Figure 9:
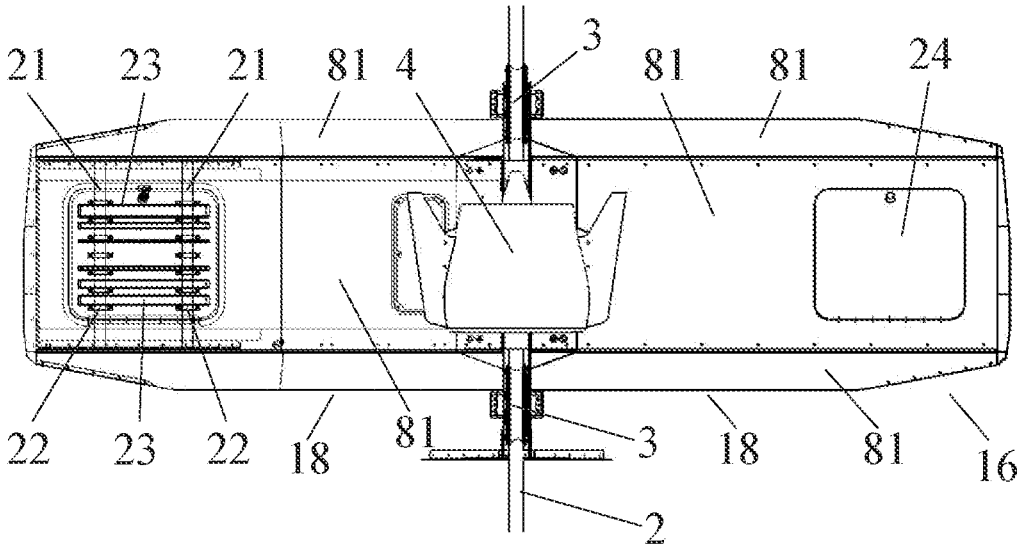
FIG. 9 is a top view of the trolley (16) as seen in FIG. 7.

The trolley (16) comprises a thrust generating unit (4) attached to the body (17) of the trolley (16) and configured to provide a forward thrust to the trolley (16). The thrust generating unit (4) is arranged above the wings (18) and positioned on the vertical axis (X) of the trolley (16) as seen in FIG. 3. The thrust generating unit (4) is the electric turbine (4). An energy storage unit is an electric battery (not shown in Figs.) provided is the trolley (16) and the electric battery is electrically connected to the electric turbine (4). The trolley (16) comprises a power control unit (not shown in Figs.) associated with the electric turbine (4) and the electric battery, and configured to provide a power from the electric battery to the electric turbine (4) in a pre-set manner.

Each wing (18) comprises a weight distribution system (20) in order to balance a centre of gravity of the trolley (16) along the vertical axis (X) of the trolley (16) depending on the uneven weight of the riders (5) of the trolley (16) (see FIG. 3). This feature allows to carry the riders (5) of various weight without compromising on stability of the zipline system.

The zipline system further comprises a retrieve track (6) configured to retrieve the trolley (16) back to the starting base (1) when the trolley (16) has reached the finish base (14) (see FIG. 1). The retrieve track (6) is an endless retrieve track (6) extended around multiple track wheels (7 to 12). The drive wheel (7) is connected to the drive motor for driving the retrieve track (6). The retrieve track system further comprises a counter-weight (13) for tensioning the retrieve track (6).

FIG. 1 also illustrates a method of control of travel of the trolley (16) in the zipline system. First of all, the rider (5) is secured in the harness (19) of the trolley (16). The trolley (16) starts its accelerated movement along the zipline (2) by means of the thrust generating unit (4). The acceleration is continued until it reaches pre-set maximum speed for approximately one third of the entire length of the zipline (2) until the trolley (16) with the rider (5) reaches position (5A). The trolley (16) continues its movement due to inertia until the trolley (16) with rider (5) reaches position (5B). After reaching position (5B) the trolley (16) rolls back to the lowest point of the zipline (2) and stops. When the trolley (16) stops it can be brought back to the starting base (1) by the means of the retrieve track (6) and when the trolley (16) reaches the starting base (1) the rider (5) is un-secured from the harness (19).

FIGS. 6 to 9 illustrate the weight distribution system (20) that is built into the space enclosed by the wing panels (81) of the wing (18). The wing (18) is made of interconnected wing panels (81) so that the wing (18) is a box like structure forming this space enclosed by the wing panels (81). The weight distribution system (20) comprises two guide bars (21) arranged within the wing (18), stoppers (22) arranged on the guide bars (21) at a predefined distance from each other, and weights (23) arranged on the guide bar (21) and between the stoppers (22). The stoppers (22) allow to arrange the weights (23) at certain positions providing easy balancing of the trolley (16). Each wing (18) comprises one weight distribution system (20). FIGS. 6 to 9 show one of two weight distribution systems (20) of the trolley (16). For easy access of the weights (23) a hole is made in the wing (18). The same hole is covered by a lid (24) so that the wings (18) can maintain its aerodynamical characteristics.

While the invention may be susceptible to various modifications and alternative forms, specific embodiments of which have been shown by way of example in the figures and have been described in detail herein, it should be understood that the invention is not intended to be limited to the particular forms disclosed. Rather, the invention includes all modifications, equivalents, and alternatives falling within the scope of the invention as defined by the following claims.

The invention claimed is:

1. A zipline system comprising:

a starting base (1);

a finish base (14);

a zipline (2) extended between the starting base (1) and the finish base (14) and attached thereto;

a trolley (16) comprising:

a body (17);

at least two wheels (3) rotationally connected to the body (17) and each wheel (3) rests on the zipline (2) so that the trolley (16) can move along the zipline (2);

a retrieve track (6) configured to retrieve the trolley (16) back to the starting base (1) when the trolley (16) has completed the ride and stopped, characterized in that the trolley (16) comprises:

two wings (18) attached to the body (17), wherein each wing (18) extends sideways from the body (17) and away from each other;

two harnesses (19), wherein each harness (19) is attached under each wing (18) and configured to secure a rider (5) of the zipline system;

a thrust generating unit (4) attached to the body (17) of the trolley (16) and configured to provide a forward thrust to the trolley (16);

an energy storage unit associated with thrust generating unit (4) and configured to store energy for the thrust generating unit (4);

a power control unit associated with the thrust generating unit (4) and the energy storage unit, and configured to provide a power from the energy storage unit to the thrust generating unit (4) in a pre-set manner;

a weight distribution system (20) connected to each wing (18) and configured to balance a centre of gravity of the trolley (16) along the vertical axis (X) of the trolley (16) depending on the uneven weight of the riders (5) of the trolley (16).

2. The zipline system according to claim 1, characterized in that the thrust generating unit (4) is arranged above or below the wings (18) and positioned on the vertical axis (X) of the trolley (16).

3. The zipline system according to claim 1, characterized in that the system comprises at least two thrust generating units (4) and each thrust generating unit (4) is arranged above or at the free ends of both wings (18) and positioned symmetrically relative to the vertical axis (X) of the trolley (16).

4. The zipline system according claim 1, characterized in that the wing (18) is made of interconnected wing panels (81) so that the wing (18) is a box like structure forming a space enclosed by said wing panels (81).

5. The zipline system according to claim 4, characterized in that the weight distribution system (20) is built in the space enclosed by the wing panels (81) of the wing (18) and the weight distribution system (20) comprises at least one guide bar (21) arranged within the wing (18), stoppers (22) arranged on the guide bar (21) at a predefined distance from each other, and weights (23) arranged on the guide bar (21) and between the stoppers (22).

6. The zipline system according to claim 1, characterized in that the attachment point (1A) of the zipline (2) to the starting base (1) and the attachment point (14A) of the zipline (2) to the finish base (14) can be on the same level.

7. The zipline system according to claim 1, characterized in that the middle section of the zipline (2) is lower than the sections of the zipline (2) at the starting base (1) and the finish base (14).

8. The zipline system according to claim 1, characterized in that the harness (19) is rigidly attached to the wing (18).

9. The zipline system according to claim 1, characterized in that the thrust generating unit (4) is selected from the group of a fan, a propeller, a jet turbine and an electric turbine.

10. A method of control of travel of the trolley (16) in the zipline system according to claim 1, wherein the method comprises the following steps:

a) securing the riders (5) in the harnesses (19) of the trolley (16) in the starting base (1);

b) balancing the trolley (16) by the means of weight distribution system (20) in order to bring the centre of gravity of the trolley (16) on the vertical axis (X) of the trolley (16);

c) accelerating the trolley (16) along the zipline (2) by means of the thrust generating unit (4) for at least a part of the zipline (2) length which is followed by the switch off of the thrust generating unit (4);

d) stopping the trolley (16);

e) returning the trolley (16) to the starting base (1) by a means of the retrieve track (6); and f) un-securing the riders (5) from the harnesses (19) of the trolley (16).

11. The method according to claim 10, characterized in that the trolley (16) is accelerated by the means of the thrust generating unit (4) until the lowest point of the zipline (2) in relation to the attachment points (1A; 14A) of the zipline (2) is reached.

* * * * *